US009408453B2

(12) United States Patent
Posnick

(10) Patent No.: US 9,408,453 B2
(45) Date of Patent: Aug. 9, 2016

(54) COSMETIC APPLICATION DEVICE

(71) Applicant: SPF Ventures, LLC, Dallas, TX (US)

(72) Inventor: Susan Posnick, Dallas, TX (US)

( * ) Notice: Subject to any disclaimer, the term of this patent is extended or adjusted under 35 U.S.C. 154(b) by 183 days.

(21) Appl. No.: 14/175,997

(22) Filed: Feb. 7, 2014

(65) Prior Publication Data

US 2014/0219705 A1 Aug. 7, 2014

Related U.S. Application Data

(63) Continuation of application No. PCT/US2012/050606, filed on Aug. 13, 2012.

(60) Provisional application No. 61/523,245, filed on Aug. 12, 2011.

(51) Int. Cl.

| | |
|---|---|
| ***A45D 33/02*** | (2006.01) |
| ***A46B 9/02*** | (2006.01) |
| ***A46B 11/00*** | (2006.01) |
| *A46B 17/04* | (2006.01) |

(52) U.S. Cl.

CPC ..... *A45D 33/02* (2013.01); *A46B 9/021* (2013.01); *A46B 11/0065* (2013.01); *A46B 17/04* (2013.01)

(58) Field of Classification Search

IPC ..... A45D 33/00,33/003, 33/02, 33/08, A45D 33/16, 33/22; A46B 11/00, 11/001, A46B 11/0062, 11/0065, 9/021, 17/04

See application file for complete search history.

(56) References Cited

U.S. PATENT DOCUMENTS

| | | | | |
|---|---|---|---|---|
| 6,932,533 | B1 | 8/2005 | Chen | 401/281 |
| 7,384,208 | B2 | 6/2008 | Bouix et al. | 401/269 |
| 7,775,737 | B2 | 8/2010 | Deans et al. | 401/281 |
| 8,550,738 | B2 * | 10/2013 | Thorpe | A45D 34/042 401/116 |
| 2003/0138285 | A1 * | 7/2003 | Petit | A45D 33/34 401/281 |
| 2007/0209675 | A1 | 9/2007 | Byun | 132/299 |

* cited by examiner

*Primary Examiner* — David Walczak

(74) *Attorney, Agent, or Firm* — J. Peter Paredes; Benjamin D. Rotman; Rosenbaum IP, P.C.

(57) ABSTRACT

The present invention relates to a cosmetic application device that includes a base member having a first surface, a second surface, and a bore there between; a powder flow conduit; a brush member; a clip; a middle body; an o-ring; a variable flow mechanism; a cartridge having a first end and a second end; and an end cap.

17 Claims, 4 Drawing Sheets

COSMETIC APPLICATION DEVICE

CROSS-REFERENCE TO RELATED APPLICATIONS

The present application claims priority to and is a continuation from PCT Application No. PCT/US2012/050606, filed Aug. 13, 2012, which claims priority from U.S. Provisional Application Ser. No. 61/523,245, filed Aug. 12, 2011, all herein incorporated by reference in their entireties.

FIELD OF THE INVENTION

The present invention relates to the field of cosmetology and, in particular, to a combined cosmetic applicator brush with cosmetic powder storage unit.

BACKGROUND

A cosmetic application device is, generally speaking with respect to the instant invention, used for application of a cosmetic powder onto one's skin, and most commonly to one's facial skin. Such devices are used wherever and whenever one finds that the addition of cosmetic powder is deemed desirable. The place of use can be in the privacy of one's dwelling, but it can also be while out literally anywhere. Accordingly, many users of cosmetic powders find it useful to use devices that combine an applicator brush with a means of storing the cosmetic powder applied by the applicator brush rather than use an applicator brush and a separate container of cosmetic powder. Obviously, the combined applicator brush/cosmetic powder device lends a degree of ease when applying the cosmetic powder having to manipulate a single device instead of at least two. The difficulty that can be encountered is that existing combined cosmetic application devices do not provide a means for controlling the flow of cosmetic powder onto the brush, resulting commonly in too little or too much cosmetic powder applied. As well, existing cosmetic application devices do not have a built-in means for adding additional cosmetic powder upon the exhaustion of the cosmetic powder that comes with the combined cosmetic application device. Accordingly, the brush of such a combined device would either have to be used with a separate container of cosmetic powder or additional cosmetic powder would have to be added to the existing cosmetic storage component of the combined device; or a new combined device would have to be purchased.

SUMMARY OF THE INVENTION

The present invention is directed at a combined applicator brush/cosmetic powder device that allows variable rates of flow of cosmetic powder from the powder chamber of a cartridge that attaches to the applicator brush assembly. In one embodiment of the invention, upon exhaustion of the cosmetic powder contained in the chamber of the cartridge, the device is either used as a stand-alone applicator brush or disposed of and replaced by a new combined applicator brush/cosmetic powder device.

In another embodiment, the present invention is directed at a combined applicator brush/cosmetic powder device that includes a first cartridge for storage of cosmetic powder (in the powder chamber thereof), which first cartridge may be replaced by a second cartridge upon either (i) the exhaustion of the cosmetic powder included in the powder chamber of the first cartridge or (ii) the desire of the user to apply a different cosmetic powder having a different hue or sunscreen characteristic or moisturizing characteristic or the like that is contained in the powder chamber of the second cartridge.

In certain embodiments of the present invention, the combined applicator brush/cosmetic powder device includes both the variable flow rate mechanism and replaceable cartridges for storage of cosmetic powders of same or different characteristics.

In yet a further embodiment of the present invention, a cap that seals the cosmetic chamber of the second cartridge can be removed therefrom and the second cartridge placed onto the combined applicator brush/cosmetic powder device after removal of the first cartridge, whereupon the cap that was earlier removed from the second cartridge is then placed onto the first cartridge. In so doing, the remaining cosmetic powder of the first cartridge will remain in the powder chamber of the first cartridge and then may be later reinserted onto the combined applicator brush/cosmetic powder device.

More details concerning these embodiments, and others, are further described in the following figures and detailed description set forth herein below.

DETAILED DESCRIPTION OF THE PREFERRED EMBODIMENTS

The present invention is described in reference to the accompanying drawings and following embodiments that are presented for purpose of illustration and should not be construed to limit the scope of the invention thereto.

A cosmetic application device that includes a base member having a first surface, a second surface, and a bore there between; a powder flow conduit; a brush member; a clip; a middle body; an o-ring; a variable flow mechanism; a cartridge having a first end and a second end; and an end cap; wherein, (i) the powder flow conduit protrudes from the first surface of the base member such that the powder flow conduit is in flow communication with the bore, (ii) the brush member is bundled around the powder flow conduit and connected to the base member by the clip, (iii) the middle body is coaxial to and surrounds the powder flow conduit, clip and base member, (iv) the o-ring is fitted on the second surface of the base member around the bore, (v) the variable flow mechanism is attached to the first end of the cartridge and connected to the second surface of the base member such that the cartridge is in flow communication with the bore through the variable flow mechanism, and (vi) the end cap covers the second end of the cartridge. In one embodiment, the cartridge containing cosmetic powder can be replaced with a replacement cartridge that contains either the same cosmetic powder or a second cosmetic powder that has, for example, different cosmetic characteristics with respect to hue, moisture, sunscreen, or the like.

Figure 1:
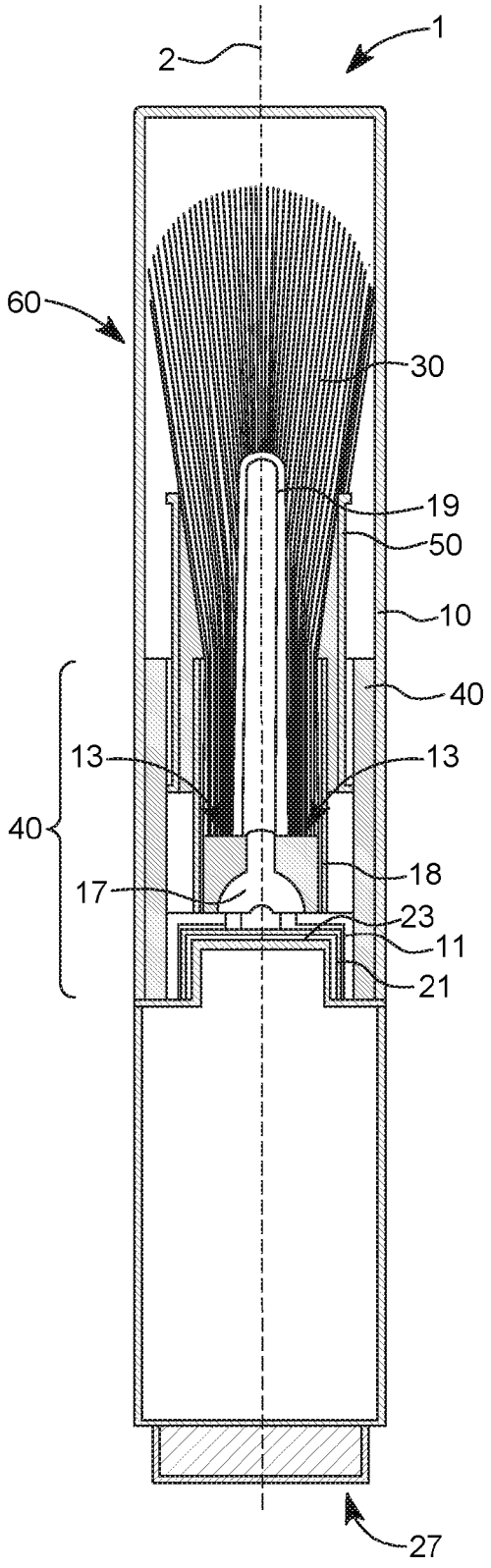
FIG. 1 is a cross section front view of one embodiment of the cosmetic application device.
Figure 2A:
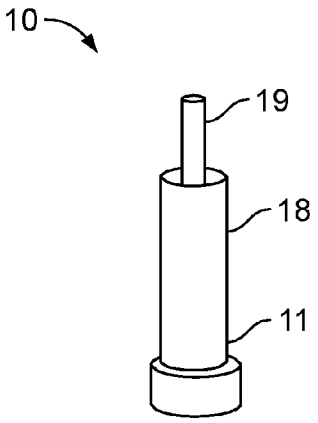
FIG. 2*a* is an exploded view of the inner body of the cosmetic application device.
Figure 2B:
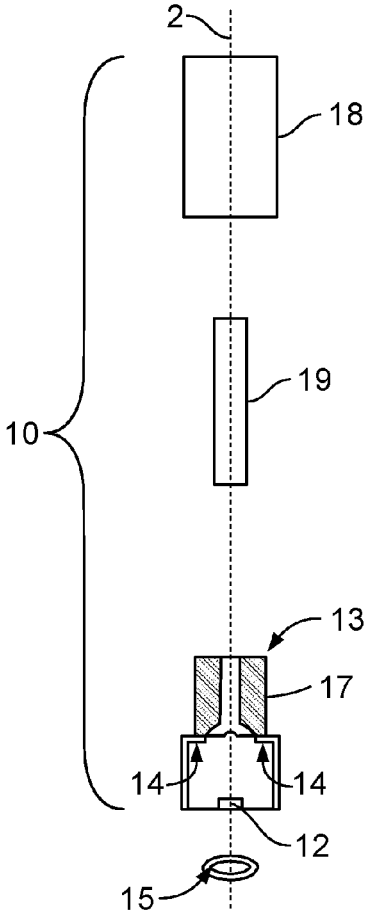
FIG. 2*b* is a perspective view of the inner body.

FIG. 1 illustrates a cross section front view of one embodiment of the cosmetic application device 1 of the present invention, which embodiment includes: (i) a longitudinal axis 2; (ii) an inner body 10 coupled to a first cartridge 20 to provide a powder flow path from the first cartridge 20 to a brush member 30; (iii) a middle body 40 that is coaxial to and surrounds the inner body 10; (iv) a brush member shield 50 functionally coupled to the middle body 40 to slide longitudinally to cover or expose the length of the brush member 30; and (v) a top cap 60 that encloses the brush member 30 and brush member shield 50.

Figure 3:
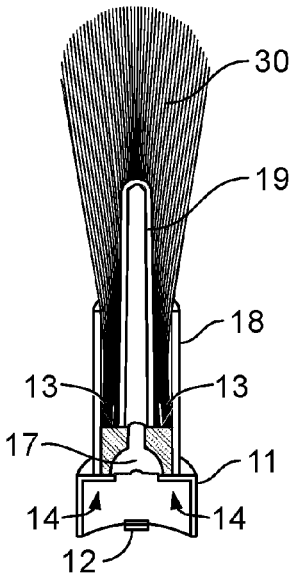
FIG. 3 is a perspective cross sectional front view of the brush member bundled and attached to the inner body.
Figure 4A:
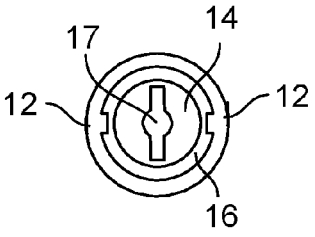
FIG. 4*a* is a front view of the second surface of the base member.
Figure 4B:
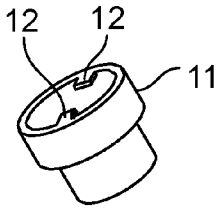
FIG. 4*b* is a perspective view of the base member.

The inner body 10 as shown in FIGS. 2*a*, 2*b*, 4*a*, and 4*b* includes a base member 11, a first set of at least two nodules 12, a first surface 13, a second surface 14, an o-ring 15, an o-ring groove 16, a tapered bore 17, a clip 18, a powder flow conduit 19, and the longitudinal axis 2. From the perspective cross sectional view in FIG. 3, one can see that, in one embodiment, the powder flow conduit 19 protrudes from the base member 11 such that the powder flow conduit 19 is in flow communication with the tapered bore 17. Also shown in FIG. 3, the brush member 30 is bundled around the powder flow conduit 19 and attached to the base member 11 by the clip 18.

Figure 6:
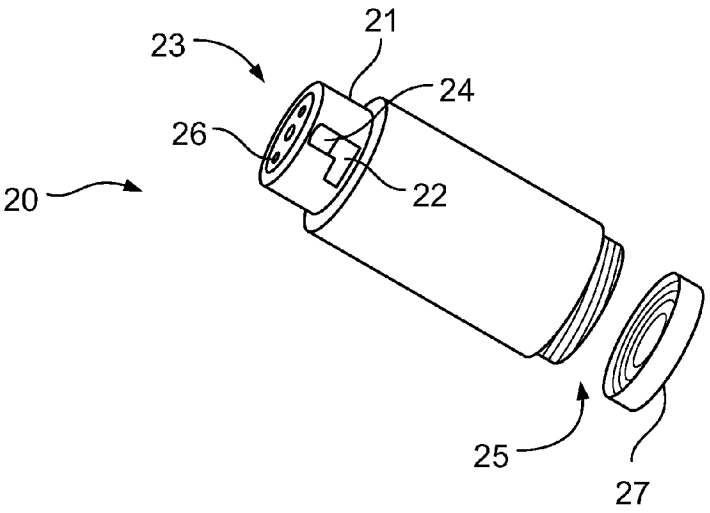
FIG. 6 is a perspective view of the variable flow mechanism attached to the replacement cartridge.
Figure 5:
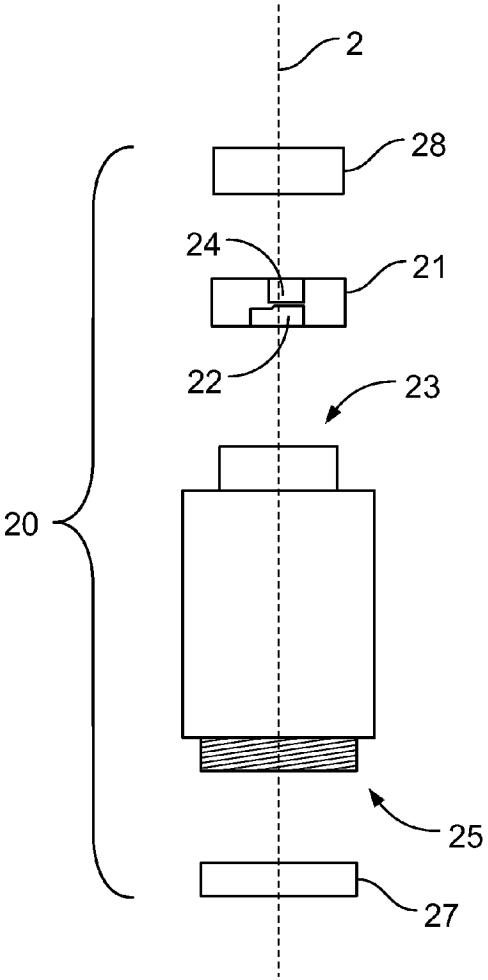
FIG. 5 is an exploded view of the replacement cartridge.
Figure 7:
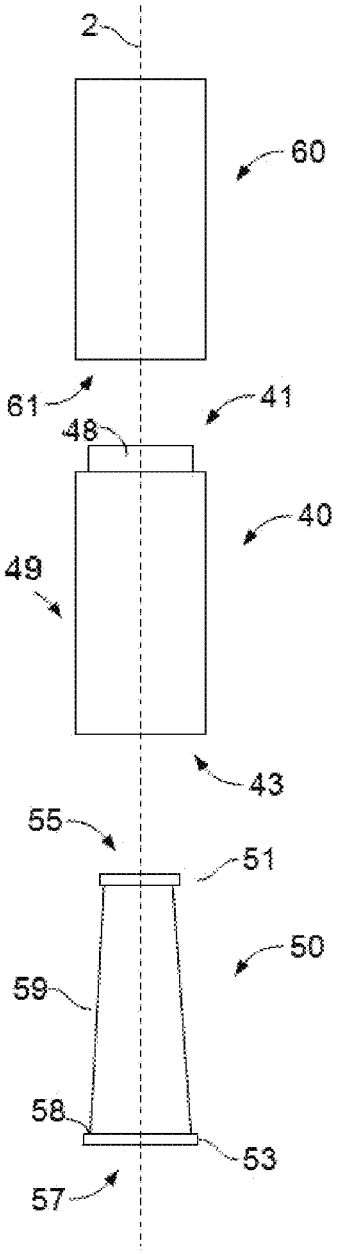
FIG. 7 is an exploded view of the middle body, brush member shield, and top cap.
Figure 10:
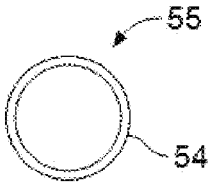
FIG. 10 is a top view facing the fifth end of the brush member shield.

As shown in FIG. 6 and the exploded view in FIG. 5, the first cartridge 20 in another embodiment includes a first end 23, a second end 25, a powder chamber internally disposed there between (not shown), and the longitudinal axis 2, where in one embodiment a variable flow mechanism 21 is attached to the first end 23 and a first end cap 27 is attached to the second end 25. An o-ring 15 is placed in the o-ring groove 16 on the second surface 14 to prevent leakage between the tapered bore 17 and the variable flow mechanism 21. The variable flow mechanism 21 is connected to the second surface 14 of the base member 11 by aligning the variable flow mechanism 21 such that the first set of nodules 12 on the base member 11 can slide into a set of notches 22 on the variable flow mechanism 21. The first set of nodules 12 and the first set of notches 22 are designed such that alignment of the first set of nodules 12 and first set of notches 22 establishes flow communication between the first cartridge 20 and the tapered bore 17 through an aperture 26 at a rate that is defined in part by the degree of opening of the aperture that is allowed by the variable flow mechanism 21. The aperture 26 can have any opening size or shape consistent with gravity-based flow of the cosmetic powder there through. Accordingly, the aperture 26 can have an opening size of at least about 0.25 mm diameter if the opening is substantially circular in shape or the equivalent area for any other shape that is suitably employed to allow flow of the cosmetic powder there through. The opening size of the aperture 26 can be as great as about 4 mm in diameter for a substantially circular opening or its equivalent area if not a circular opening. In one embodiment, the opening size of the aperture ranges from about 0.25 mm up to about 4 mm in diameter for a substantially circular opening or its respective equivalents if not a circular opening; from about 0.5 mm to about 3 mm diameter openings, from about 0.75 mm up to about 2.5 mm diameter openings, from about 1 mm up to about 2 mm diameter openings; wherein the diameters stated are for substantially circular openings or indicative of the respective equivalent areas for non-circular openings. In one embodiment of the present invention, the aperture 26 is about 1.5 mm in diameter for a circular opening or its equivalent area for a non-circular opening.

The rate of flow is also impacted by the degree off of the vertical that the cosmetic application device 1 is held while the aperture 26 is open.

Flow communication from the first cartridge 20 to the cosmetic application end of the brush member 30 is established by flow communication from the powder chamber (not shown) contained within the first cartridge 20 to the distal opening of the powder flow conduit 19 in the brush member 30 by way of the aperture 26 and the tapered bore 17 to the proximal opening of the powder flow conduit 19.

Connection between the variable flow mechanism 21 and the second surface 14 is maintained by a second set of nodules 24 preventing longitudinal movement of the cartridge 20 relative to the inner body 10.

Each of the set of notches 22 in one embodiment is L-shaped providing rotational movement around a longitudinal axis 2. Rotational movement in one direction will close the aperture 26 until fully covered by the second surface 14 and rotational movement in the opposite direction will open the aperture 26 until unimpeded by the second surface 14. The degree of rotation controls the level of flow communication between the first cartridge 20 and the tapered bore 17 through aperture 26 by controlling the amount of aperture 26 that is covered by the second surface 14.

In another embodiment, each set of notches 22 is L-shaped and includes nodules providing discrete settings to control the aperture 26 opening, e.g. a substantially open setting, about a two-third open setting, about a one-third open setting, and a substantially closed setting. In another example, the aperture 26 can be set to be substantially open, about half open, and substantially closed. The prior art does include at least one applicator allowing variable flow rate dependent on relative positions of the aperture and surfaces, however the mechanism as disclosed by U.S. Pat. No. 7,775,737 does not provide the user a mechanism for knowing to what extent the flow is open or closed.

In another example, the aperture 26 can be set to be substantially open, about half open, and substantially closed. The prior art does include at least one applicator allowing variable flow rate dependent on relative positions of the aperture and surfaces, however the mechanism as disclosed by U.S. Pat. No. 7,775,737 does not provide the user a mechanism for knowing to what extent the flow is open or closed.

In another embodiment, the second end 25 and the first end cap 27 are threaded such that the end cap is connected by screwing on to the second end 25. In an alternative embodiment, the first end cap 27 connects or attaches to the second end 25 of the first cartridge 20 by frictional means or adhesion means.

Another embodiment includes a second end cap 28 to cover the variable flow mechanism 21 to prevent outflow of powder from the aperture 26 when the first cartridge 20 is detached and replaced with a second cartridge (not shown). The second end cap 28 can attach by threading, friction, or adhesion, as with respect to the first end cap 27.

Figure 8:
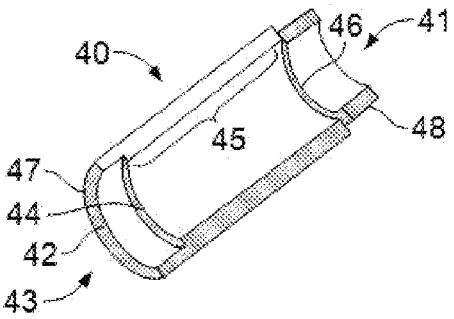
FIG. 8 is a longitudinal cross section perspective view of the middle body.

As illustrated in FIG. 8, the middle body 40 of an embodiment of the present invention includes: (i) a third end 41; (ii) a fourth end 43; (iii) a first inner diameter 42; (iv) a second inner diameter 44; (v) an inner length 45; (vi) a third inner diameter 46; (vi) a first outer diameter 47; (vii) a second outer diameter 48; and (ix) a first outer surface 49; wherein the first inner diameter 42 is larger than the second inner diameter 44 and the second inner diameter 44 is larger than the third inner diameter 46, the first outer diameter 47 is larger than the second outer diameter 48, and the inner length 45 is the shortest length between the first inner diameter 42 and the third inner diameter 46.

Figure 9:
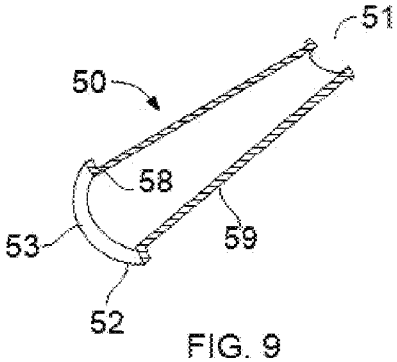
FIG. 9 is a longitudinal cross section perspective view of the brush member shield.

As illustrated in FIG. 9 showing another embodiment, the brush member shield 50 is substantially a conical frustum that includes: (i) a fifth end 55; (ii) a sixth end 57; (iii) a second outer surface 59; (iv) a first annular projection 51 on the fifth end 55; (v) a second annular projection 53 on the sixth end 57; (vi) a third outer diameter 52 on the second annular projection 53; (vii) a fourth outer diameter 54 on the first annular projection 51; and (viii) a sixth outer diameter 58 at the juncture of the second annular projection 53 and the second outer surface 59.

In an embodiment of the present invention: the fourth outer diameter 54 is smaller than the third inner diameter 46 so that the fifth end 55 can pass through the third end 41; the third outer diameter 52 is larger than the third inner diameter 46 and smaller than the second inner diameter 44 so that the longitudinal movement of the brush member shield 50 is prevented by contact between the second annular projection 53 and the third inner diameter 46; the amount of longitudinal movement is limited by the inner length 45; and the sixth outer diameter 58 is substantially the same as the third inner diameter 46 to prevent lateral movement of the brush member shield 50 after the contact between the second annular projection 53 and the third inner diameter 46.

In another embodiment brush member shield 50 includes a second annular projection 53 that is threaded and an inner length 45 that is threaded such that rotating the brush member shield 50 imparts longitudinal movement of the brush member shield 50, thus shielding a variable length of the brush member 30. The longitudinal movement of the brush member shield can vary the stiffness of the brush, i.e., as the brush member shield covers more of the brush member, the brush member becomes stiffer. In an alternative embodiment the brush member shield 50 and the inner length 45 are configured with notches and nodules to provide steps along the inner length of the brush member 30 revealing differing lengths thereof. Accordingly, e.g., about one-quarter inch, about three-eighths of an inch, and about a half inch of the brush member 30 can be exposed at its powder brushing end by suitable relative placements of nodules and notches.

In an embodiment of the present invention: the inner body 10 is fastened to the middle body 40 with an adhesive such that the inner body is coaxial to and surrounded by the middle body 40 and a portion of the brush member 30 extends beyond the middle body 40; and the inner body 10 is also coaxial to and surrounded by the brush shield member 50 when the brush member 30 is exposed.

Figure 11:
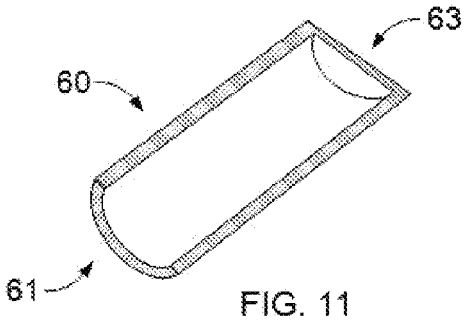
FIG. 11 is a longitudinal cross section perspective view of the top cap.

The top cap 60 includes an open end 61 end and a closed end as illustrated in FIG. 11. The top cap 60 fits over the first outer surface 49 to enclose the brush member 30 and the brush member shield 50.

The cartridge 20 includes a powder chamber (not shown) where the cosmetic powder is stored. The cosmetic powder used in the context of the present invention is any that has sufficient flow characteristics for flowing through an aperture that can be set to an opening size of about 1.5 mm diameter if circular in shape, or an equivalent area if of a different shape, as can be selected by those skilled in the art. Other cosmetic powders have flow characteristics suitable for a range of aperture diameters between about a quarter millimeter to about four millimeters, about a half millimeter to about three millimeters, about one millimeter to about two millimeters, and equivalent areas for non-circular openings. The cosmetic powder can differ as to its chemical content so as to present any hue, moisture level, sunscreen level, or any other feature of a cosmetic powder that is usefully employed in the context of cosmetology and that are generally known in the art now and in the future.

While the present invention has been described with reference to embodiments featured in the accompanying figures, the description is illustrative of the invention and is not to be construed as limiting the invention. Various modifications to the embodiments set forth herein above and claimed below may be apparent to those skilled in the art without departing from the invention in its broader aspects. The appended claims therefore are intended to cover all such modifications as fall within the true scope and spirit of the invention.

What is claimed is:

1. A cosmetic application device comprising:

a. a base member having a first surface, a second surface, and a bore there between;

b. a powder flow conduit;

c. a brush member;

d. a clip;

e. a middle body having a longitudinal axis, a third end and forth end, a first inner diameter, a second inner diameter, an inner length, a third inner diameter, a first outer diameter, a second outer diameter, and a first outer surface wherein the first inner diameter is larger than the second inner diameter and the second inner diameter is larger than the third inner diameter;

f. an o-ring;

g. a variable flow mechanism;

h. a first powder cartridge having a first end and a second end; and i. a first end cap;

j. a brush member shield having a fifth end with a fourth outer diameter, the fourth outer diameter smaller than the third inner diameter, a sixth end with a third outer diameter, the third outer diameter larger than the third inner diameter, and a longitudinal length between the fifth end and the sixth end wherein the brush member shield is coaxially disposed within the middle body along the longitudinal axis such that the brush member shield may traverse the longitudinal axis but is limited from movement by the interference between the third outer diameter and the third inner diameter; and wherein, (i) the powder flow conduit protrudes from the first surface of the base member such that the powder flow conduit is in flow communication with the bore, (ii) the brush member is bundled around the powder flow conduit and connected to the base member by the clip, (iii) the middle body is coaxial to and surrounds the powder flow conduit, clip and base member, (iv) the o-ring is fitted on the second surface of the base member around the bore, (v) the variable flow mechanism is attached to the first end of the first powder cartridge and connected to the second surface of the base member such that the first powder cartridge is in flow communication with the bore through the variable flow mechanism, and (vi) the end cap covers the second end of the first powder cartridge.

2. The cosmetic application device of claim 1, further comprising a second cartridge.

3. The cosmetic application device of claim 2, wherein the first cartridge can be replaced by the second cartridge.

4. The cosmetic application device of claim 3, further comprising a second end cap.

5. The cosmetic application device of claim 1, wherein the variable flow mechanism is turnable.

6. The cosmetic application device of claim 1, further comprising a top cap.

7. The cosmetic application device of claim 1, wherein the bore is tapered.

8. A cosmetic application device comprising:

a. a base member having a first surface, a second surface, and a bore there between;

b. a powder flow conduit;

c. a brush member;

d. a clip;

e. a middle body having a longitudinal axis, a third end and forth end, a first inner diameter, a second inner diameter, an inner length, a third inner diameter, a first outer diameter, a second outer diameter, and a first outer surface wherein the first inner diameter is larger than the second inner diameter and the second inner diameter is larger than the third inner diameter;

f. an o-ring;

g. a first powder cartridge having a first end and a second end;

h. a second powder cartridge having a first end and a second end; and i. a first end cap;

j. a brush member shield having a fifth end with a fourth outer diameter, the fourth outer diameter smaller than the third inner diameter, a sixth end with a third outer diameter, the third outer diameter larger than the third inner diameter, and a longitudinal length between the fifth end and the sixth end wherein the brush member shield is coaxially disposed within the middle body along the longitudinal axis such that the brush member shield may traverse the longitudinal axis but is limited from movement by the interference between the third outer diameter and the third inner diameter; and wherein, (i) the powder flow conduit protrudes from the first surface of the base member such that the powder flow conduit is in flow communication with the bore, (ii) the brush member is bundled around the powder flow conduit and connected to the base member by the clip, (iii) the middle body is coaxial to and surrounds the powder flow conduit, clip and base member, (iv) the o-ring is fitted on the second surface of the base member around the bore, (v) the second powder cartridge connected to the second surface of the base member such that the second powder cartridge is in flow communication with the powder flow conduit through the bore, and (vi) the first end cap covers the second end of the second powder cartridge.

9. The cosmetic application device of claim 8, further comprising a second end cap.

10. The cosmetic application device of claim 8, further comprising a variable flow mechanism.

11. The cosmetic application device of claim 8, further comprising a top cap.

12. The cosmetic application device of claim 8, wherein the bore is tapered.

13. A cosmetic application device comprising:

a. a base member having a first surface, a second surface, and a bore there between;

b. a powder flow conduit;

c. a brush member, d. a clip;

e. a middle body having a longitudinal axis, a third end and forth end, a first inner diameter, a second inner diameter, an inner length, a third inner diameter, a first outer diameter, a second outer diameter, and a first outer surface wherein the first inner diameter is larger than the second inner diameter and the second inner diameter is larger than the third inner diameter;

f. an o-ring;

g. a variable flow mechanism;

h. a first powder cartridge having a first end and a second end;

i. a second powder cartridge having a first end and a second end; and j. a first end cap;

k. a brush member shield having a fifth end with a fourth outer diameter, the fourth outer diameter smaller than the third inner diameter, a sixth end with a third outer diameter, the third outer diameter larger than the third inner diameter, and a longitudinal length between the fifth end and the sixth end wherein the brush member shield is coaxially disposed within the middle body along the longitudinal axis such that the brush member shield may traverse the longitudinal axis but is limited from movement by the interference between the third outer diameter and the third inner diameter; and wherein, (i) the powder flow conduit protrudes from the first surface of the base member such that the powder flow conduit is in flow communication with the bore, (ii) the brush member is bundled around the powder flow conduit and connected to the base member by the clip, (iii) the middle body is coaxial to and surrounds the powder flow conduit, clip and base member, (iv) the o-ring is fitted on the second surface of the base member around the bore, (v) the variable flow mechanism is attached to the first end of the second powder cartridge and connected to the second surface of the base member such that the second powder cartridge is in flow communication with the bore through the variable flow mechanism; and (vi) the first end cap covers the second end of the second powder cartridge.

14. The cosmetic application device of claim 13, further comprising a second end cap.

15. The cosmetic application device of claim 14, wherein the first end cap or the second end cap is threaded.

16. The cosmetic application device of claim 13, further comprising a top cap.

17. The cosmetic application device of claim 13, wherein the bore is tapered.

* * * * *